US007493075B2

(12) United States Patent
Shintani et al.

(10) Patent No.: US 7,493,075 B2
(45) Date of Patent: Feb. 17, 2009

(54) CLEANING DEVICE, PROCESS CARTRIDGE AND IMAGE FORMING APPARATUS

(75) Inventors: Takeshi Shintani, Kanagawa (JP); Takuji Yoneda, Tokyo (JP); Toshio Koike, Kanagawa (JP); Masato Yanagida, Tokyo (JP); Naohiro Kumagai, Kanagawa (JP); Hiroyuki Nagashima, Kanagawa (JP); Atsuhsi Sampe, Kanagawa (JP); Eisaku Murakami, Tokyo (JP); Masanori Kawasumi, Kanagawa (JP); Takeshi Uchitani, Kanagawa (JP); Masami Tomita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/685,660

(22) Filed: Mar. 13, 2007

(65) Prior Publication Data

US 2007/0154246 A1 Jul. 5, 2007

Related U.S. Application Data

(62) Division of application No. 10/836,264, filed on May 3, 2004, now Pat. No. 7,228,099.

(30) Foreign Application Priority Data

May 12, 2003 (JP) ..... 2003-132989

(51) Int. Cl.
*G03G 21/00* (2006.01)

(52) U.S. Cl. ..... 399/346

(58) Field of Classification Search ..... 399/346, 399/349, 350, 358

See application file for complete search history.

(56) References Cited

U.S. PATENT DOCUMENTS 4,640,608 A * 2/1987 Higaya et al. ..... 399/102
4,739,370 A 4/1988 Yoshida et al.
4,974,030 A 11/1990 Tokunaga et al.

(Continued)

FOREIGN PATENT DOCUMENTS

JP 04340990 A 11/1992

(Continued)

OTHER PUBLICATIONS

U.S. Appl. No. 11/685,660, filed Mar. 13, 2007, Shintani et al.

(Continued)

*Primary Examiner*—Robert Beatty
(74) *Attorney, Agent, or Firm*—Oblon, Spivak, McClelland, Maier & Neustadt, P.C.

(57) ABSTRACT

A cleaning device, a process cartridge, and an image forming apparatus including an antifriction agent coating part and a toner removing part. The antifriction agent coating part coats a solid antifriction agent on the surface of an image support body, and is disposed in an upstream side from a cleaning blade with respect to a rotational direction of the image support body. The toner removing part removes toner particles, and is disposed in an upstream side from the antifriction agent coating part with respect to the rotational direction of the image support body and a portion of the toner removing part is positioned below a portion of the antifriction agent coating part in a vertical direction perpendicular to the ground.

15 Claims, 5 Drawing Sheets

U.S. PATENT DOCUMENTS

| | | | | |
|---|---|---|---|---|
| 5,885,743 | A | 3/1999 | Takayanagi et al. | |
| 6,060,205 | A | 5/2000 | Takeichi et al. | |
| 6,415,129 | B2 * | 7/2002 | Sawayama | 399/353 |
| 6,852,462 | B2 | 2/2005 | Emoto et al. | |
| 7,022,450 | B2 * | 4/2006 | Asano et al. | 430/120.1 |
| 7,149,465 | B2 | 12/2006 | Amemiya et al. | |
| 7,228,099 | B2 * | 6/2007 | Shintani et al. | 399/346 |
| 2005/0084271 | A1 | 4/2005 | Kumagai et al. | |
| 2005/0232665 | A1 | 10/2005 | Toshio et al. | |
| 2005/0232666 | A1 | 10/2005 | Ojimi et al. | |
| 2006/0039726 | A1 | 2/2006 | Shintani et al. | |
| 2007/0036595 | A1 | 2/2007 | Amemiya et al. | |
| 2007/0071525 | A1 | 3/2007 | Yoshino et al. | |

FOREIGN PATENT DOCUMENTS

| | | | |
|---|---|---|---|
| JP | 05053485 | A | 3/1993 |
| JP | 8-248849 | | 9/1996 |
| JP | 11-288194 | | 10/1999 |
| JP | 2001051561 | A * | 2/2001 |
| JP | 2001-235987 | | 8/2001 |
| JP | 2001235987 | A | 8/2001 |

OTHER PUBLICATIONS

U.S. Appl. No. 12/167,564, filed Jul. 3, 2008, Hatori et al.

* cited by examiner

CLEANING DEVICE, PROCESS CARTRIDGE AND IMAGE FORMING APPARATUS

CROSS-REFERENCE TO RELATED APPLICATIONS

This application is a division of application Ser. No. 10/836,264, filed on May 3, 2004, which claims priority to JP 2003-132989, filed on May 12, 2003, the entire contents of each of which are incorporated herein by reference.

BACKGROUND OF THE INVENTION

1. Field of the Invention

The present invention relates to a cleaning device incorporated in an electrophotographic image forming apparatus such as a copier, a printer and a facsimile. More particularly, the present invention relates to a cleaning device for an image forming apparatus that uses high roundness toner to develop images.

2. Description of the Related Art

In order to enhance image quality, smaller diameter and higher roundness toner is being intensively designed at present. Since pulverized toner has limited characteristics on the toner diameter and the toner roundness thereof, polymerized toner manufactured, for example, in accordance with suspension polymerization, emulsion polymerization and dispersion polymerization, has been widely adopted to realize small diameter and high roundness toner.

It is known by those skilled in the art that high roundness toner has a poor cleaning characteristic in general. This is why when such high roundness toner is cleaned up with a rubber blade, which is conventionally used as means for cleaning pulverized toner, it is difficult for the rubber blade to catch the high roundness toner particles at the blade edge thereof because of tumbling of the round particles. As a result, the high roundness toner particles tend to pass through the rubber blade. In particular, since polymerized toner particles are shaped as true round particles (having average roundness above 0.98), it is difficult to properly clean up such high roundness toner particles in conventional blade cleaning methods as described above.

Some cleaning methods for high roundness toner have been proposed as follows.

Japanese Laid-Open Patent Application No. 08-248849 discloses a method of removing toner particles electrostatically from an image support body by means of a brush roller by applying bias having inverse polarity of toner electrifying polarity to the brush roller. However, the method has some problems. Typically, since remaining toner particles are not uniformly electrified on the image support body, it is difficult for the uniformly bias-applied brush roller to successfully catch the remaining toners from the image support body. Also, there is a risk that the caught toner particles may be reattached on the image support body depending on the level of the applied bias.

There are some other approaches. In a proposed cleaning method, for the purpose of improving cleaning performance of a rubber blade, the friction coefficient of the surface of an image support body can be lowered by supplying an antifriction material on the surface. In this method, even if greater depression force of a rubber blade is applied to the image support body in order to scrape remaining toner particles from the image support body, it is possible to suppress damage to the image support body. In addition, it is possible to improve cleaning performance of the rubber blade by lowering the coefficient of sliding friction of the toner particles.

Japanese Laid-Open Patent Applications No. 11-288194 and No. 2001-235987 disclose methods of supplying an antifriction material on an image support body. In these methods, a solid antifriction material is applied to a brush roller disposed in the upstream side from a rubber blade with respect to the rotational direction of an image support body so that the brush roller can clean up the surface of the image support body. At the same time, the solid antifriction material is scraped while supplying the antifriction material on the image support body. According to the above-proposed methods, however, when toner particles are accumulated between fibers of a brush roller over time, there is a risk that an antifriction material scraped by the brush roller cannot be sufficiently supplied on the image support body.

SUMMARY OF THE INVENTION

It is a general object of the present invention to provide a cleaning device in which one or more of the above-mentioned problems are eliminated.

A first more specific object of the present invention is to provide an improved cleaning device that can maintain good performance of cleaning up polymerized toner in the long term.

A second more specific object of the present invention is to provide a process cartridge and an image forming apparatus that include the cleaning device.

A third more specific object of the present invention is to provide toner preferably used for the process cartridge and the image forming apparatus.

In order to achieve the above-mentioned objects, there is provided according to one aspect of the present invention a cleaning device for cleaning a surface of an image support body, including: a cleaning blade being disposed in contact with the surface of the image support body; an antifriction agent coating part coating a solid antifriction agent on the surface of the image support body, said antifriction agent coating part being disposed in an upstream side from the cleaning blade with respect to a rotational direction of the image support body; and a toner removing part removing toner particles, said toner removing part being disposed in an upstream side from the antifriction agent coating part with respect to the rotational direction of the image support body.

Additionally, there is provided according to another aspect of the invention a process cartridge for an image forming apparatus wherein the process cartridge is detachably mounted in the image forming apparatus, the process cartridge including: an image support body supporting a latent image; and the above-mentioned cleaning device.

Additionally, there is provided according to another aspect of the invention an image forming apparatus including the above-mentioned cleaning device.

Additionally, there is provided according to another aspect of the invention toner for a development step of an electrophotography process of an image forming apparatus including the above-mentioned cleaning part, the toner including: a colorant; and binder resin, wherein each particle of the toner has an average roundness greater than or equal to 0.93.

According to one aspect of the present invention, it is possible to provide a cleaning device that can have and maintain improved cleaning performance in the long term even if polymerization toner is used. Also, it is possible to provide a process cartridge and an image forming apparatus that can use the cleaning device therein to prevent cleaning malfunction of an image support body, thereby forming high-quality images.

Other objects, features and advantages of the present invention will become more apparent from the following detailed description when read in conjunction with the accompanying drawings.

DETAILED DESCRIPTION OF THE PREFERRED EMBODIMENTS

Figure 1:
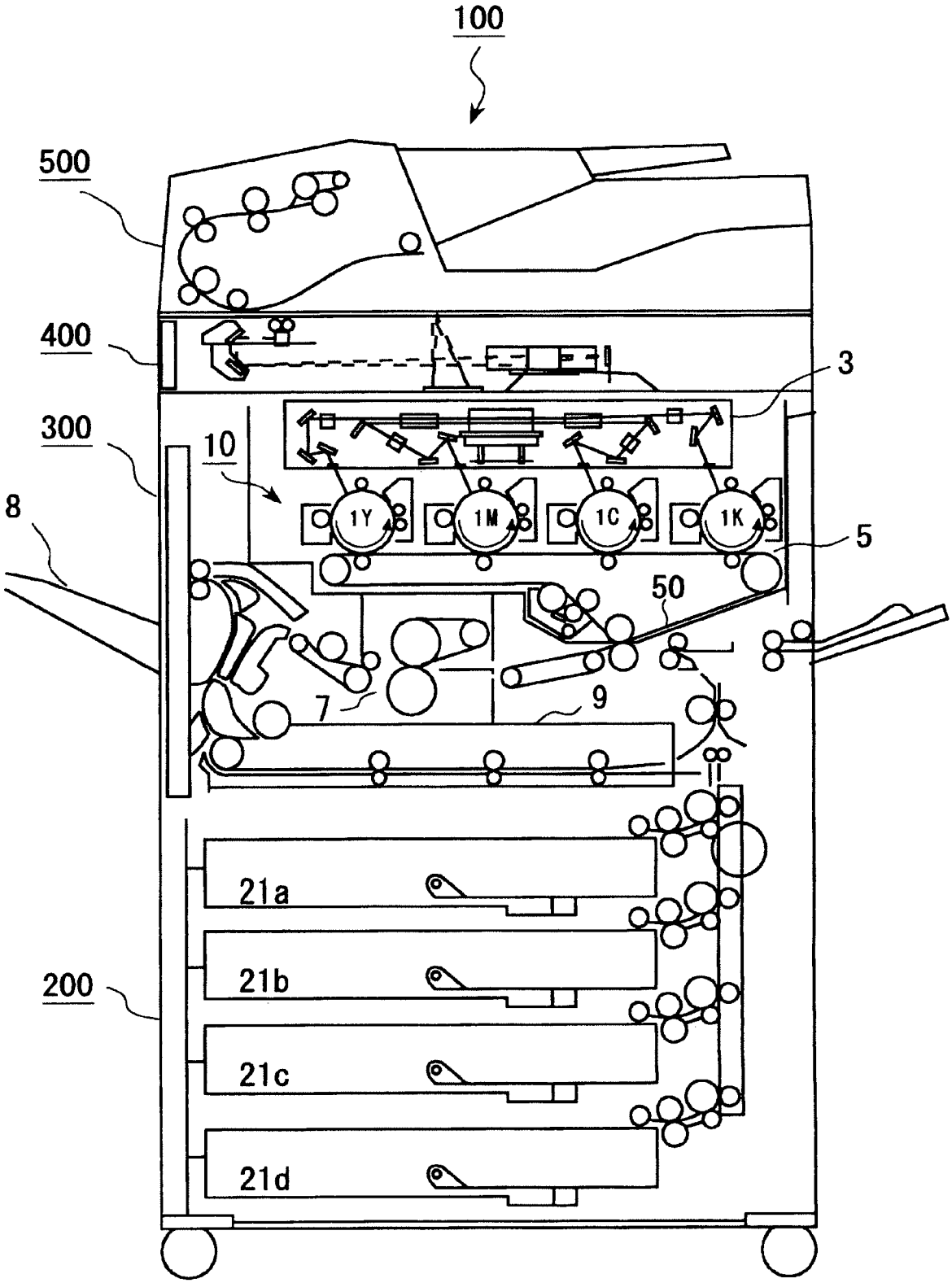
FIG. 1 shows an exemplary structure of an image forming apparatus according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 shows an exemplary structure of an image forming apparatus according to an embodiment of the present invention. In the following, a full-color copier is used to exemplify this embodiment.

Referring to FIG. 1, an image forming apparatus 100 includes an image formation part 300, a paper supply part 200, a manuscript reading part 400, and a manuscript carrying part 500. The image formation part 300 includes an image formation unit 10, an exposing part 3, a transferring part 5 and a fixing part 7.

In the image formation unit 10, four units to form respective color toner images corresponding to black (K), cyan (C), magenta (M) and yellow (Y) are aligned, as illustrated in FIG. 1. The image formation unit 10 includes four photoconductors 1K, 1C, 1M and 1Y corresponding to the four colors K, C, M and Y, respectively. In the vicinity of each photoconductor, an electrifying part, a developing part and a cleaning part are provided.

The exposing part 3 converts data read by the manuscript reading part 400 or image signals supplied from an external device (not illustrated) such as PC (Personal Computer), and uses a polygon motor to conduct laser ray scanning. Then, the exposing part 3 forms electrostatic latent images on the photoconductors 1 based on image signals read via a mirror.

The transferring part 5 includes an immediate transfer belt 50 for superimposing respective color toner images on the four color photoconductors 1 sequentially and holding the superimposed images. Then, the color toner images on the immediate transfer belt 50 are transferred onto a recording paper. Alternatively, a recording paper is carried by a transfer carrier belt, and color toner images on the photoconductors 1 may be transferred onto the recording paper directly.

The fixing part 7 includes a pressure applying roller and a belt tensed by rollers incorporating a heat source such as a halogen heater. During passage through a nip part between the pair of rollers, heat and pressure are applied to the color toner image on the recording paper to fix the toner image. Alternatively, a pair of rollers or a pair of belts may be used as the fixing part 7.

The image forming apparatus 100 may optionally include a both-side reversing unit 9 and an output paper tray 8.

Figure 2:
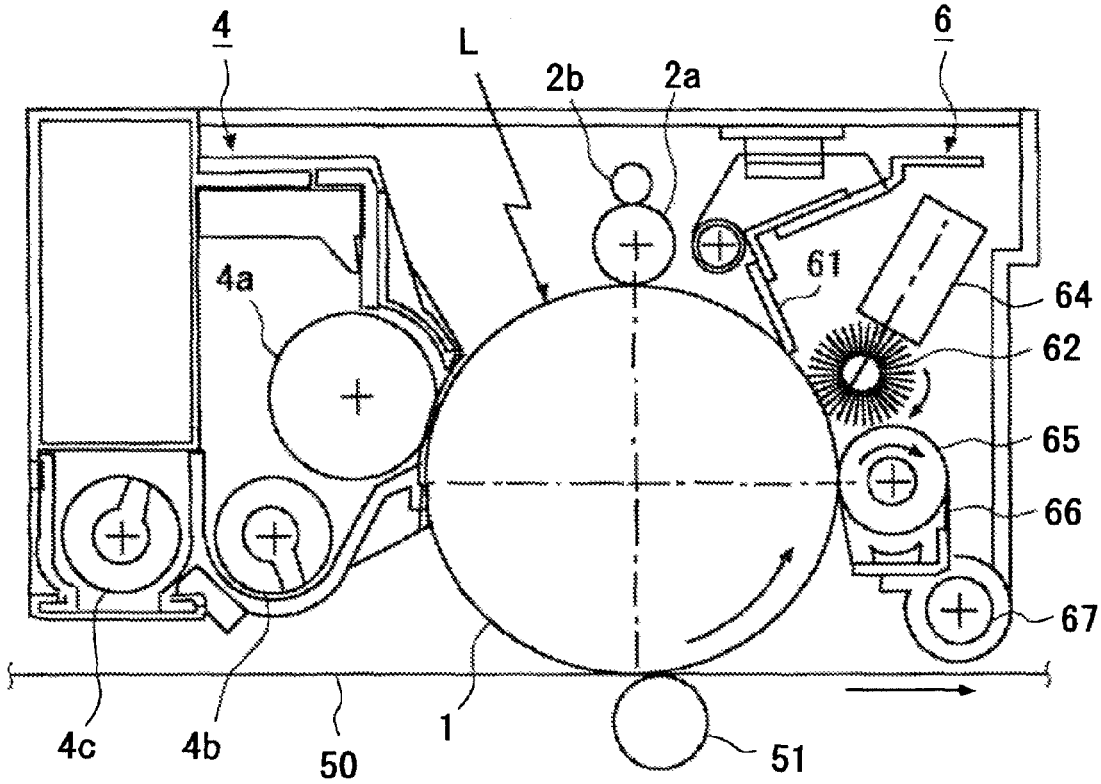
FIG. 2 is an enlarged view showing an image forming unit of the image forming apparatus shown in FIG. 1.

FIG. 2 is an enlarged view showing the image formation unit 10 shown in FIG. 1.

Referring to FIG. 2, the photoconductor 1 may be formed of photoconductive amorphous metal such as amorphous silicon and amorphous selenium. Alternatively, the photoconductor 1 may be formed of organic compounds such as bisazo pigment and phthalocyanine pigment. If an environmental influence and postprocessing after use thereof are taken into account, an OPC photoconductor in use of an organic compound is preferred.

The electrifying part 2 may be any of a corona type, a roller type, a brush type and a blade type. In the illustration, the electrifying part 2 is configured from a roller type electrifying device. Also, the electrifying part 2 includes a power source (not illustrated) connected to an electrifying roller 2*a* and an electrifying roller cleaning member 2*b*, which is disposed in contact with the electrifying roller 2*a*, for the purpose of cleaning the electrifying roller 2*a*. When a high voltage is applied to the electrifying roller 2*a*, corona to uniformly electrify the surface of the photoconductor 1 is discharged between the electrifying part 2 and the photoconductor 1.

The developing part 4 includes a developer support body 4*a* to supply a developer supported therein to the photoconductor 1 and a toner supply room 4*b*. The developer support body 4*a* is hollow-cylinder shaped and is rotatably supported. The developing support body 4*a* accommodates a magnet roll fixed to have the same rotational axis as the rotatable developer support body 4*a*. The developer is magnetically absorbed and carried on the outer circumferential surface of the developer support body 4*a*. The developer support body 4*a*, which is made of a conductive and non-magnetic member, is connected to a power source (not illustrated) for applying development bias. An electric field is formed in a development area by providing a voltage from the power source between the developer support body 4*a* and the photoconductor 1.

A primary transfer part 51 is disposed at a position opposite to the photoconductor 1 across sandwiching the immediate transfer belt 50. The primary transfer part 51 is connected to a power source (not illustrated). When a toner image on the photoconductor 1 is to be transferred onto the immediate transfer belt 50, a voltage is applied to the primary transfer part 51. Then, an electric field is formed between the photoconductor 1 and the immediate transfer belt 50, and thereby the toner image is electrostatically transferred.

As shown in FIG. 2, a cleaning device 6 according to an embodiment of the present invention includes a cleaning blade 61, an antifriction material coating part 62 and a toner removing part 65. The cleaning blade 61 is disposed in contact with the photoconductor 1. The antifriction material coating part 62, which is disposed in the upstream side from the cleaning blade 61 with respect to the rotational direction of the photoconductor 1, scrapes an antifriction material from a solid antifriction material 64 and supplies the scraped antifriction material on the photoconductor 1. The toner removing part 65 is disposed in the further upstream side from the antifriction material coating part 62 with respect to the rotational direction of the photoconductor 1. After completion of primary transferring, the toner removing part 65 removes remaining toner particles from the photoconductor 1. Then, the antifriction material coating part 62 supplies particles scraped from the solid antifriction material 64 to the photoconductor 1, and the cleaning blade 65 scrapes away the remaining toner and filming from the photoconductor 1.

Solid antifriction material 64 is located above antifriction material coating part 62 which in turn is located above toner removing part 65. Toner transfer screw 67 is located below toner removing part 65. As clearly illustrated by FIG. 2, a portion of the toner removing part 65 is positioned below a portion of the antifliction material coating part in a vertical direction perpendicular to the ground. A portion of the solid antifriction material 64 is also illustrated by FIG. 2 to be above a portion of the toner removing part 65 in the vertical direction perpendicular to the ground. A portion of the solid antifriction material 64 is also illustrated by FIG. 2 to be above the toner transfer screw 67 in the vertical direction perpendicular to the ground.

The toner removing part 65 can be configured from various means such as a rubber blade and a fur brush. Preferably, the toner removing part 65 is configured to have a conductive elastic roller 65 and a hard blade 66 to scrape away toner particles attached on the surface of the elastic roller 65, as illustrated in FIG. 2. The toner removing part 65 having such configuration can efficiently remove toner particles without damage to the surface of the photoconductor 1. The elastic roller 65 includes a core having 20° through 60° of Asker C and an elastic layer made of a rubber material having a volume resistivity of $1\times10^3$ through $1\times10^8$ Ω·cm. Even if the elastic roller 65 having hardness within the above ranges is in contact with the surface of the photoconductor 1, the photoconductor 1 can be less damaged.

Also, for the purpose of efficient catching of toner particles, it is preferable that bias having inverse polarity of the toner be applied from a power source (not illustrated) to the elastic roller 65 so as to electrostatically catch the toner particles from the surface of the photoconductor 1. Also, it is preferable that such applied bias be direct current or bias resulting from superposition of direct current and alternate current. The level of the bias is set to be less than or equal to the voltage at discharge start time.

The hard blade 66 for scraping away toner particles from the surface of the elastic roller 65 is preferably made of a hard and non-magnetic metal material having low electrical resistance. In particular, the hard blade 66 is preferably made of stainless steel (SUS). In this embodiment, a SUS plate member having 0.15 mm in thick is adopted to correspond to a greater layer thickness of supplied toner.

Since the elastic roller 65 is in contact with the hard blade 66, the elastic roller 65 is preferably configured to have the following structure.

Figure 3:
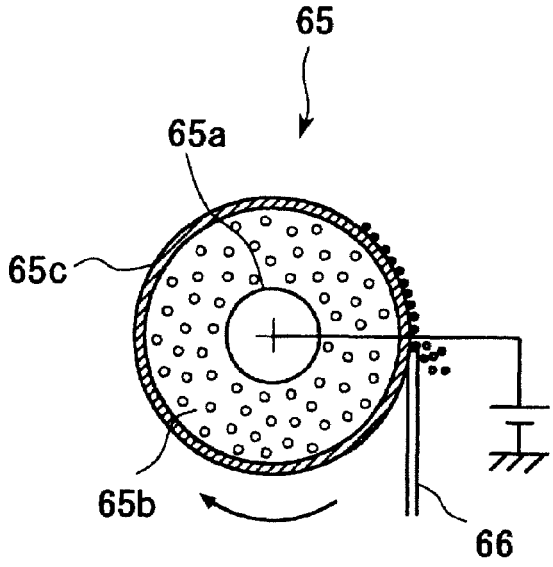
FIG. 3 shows an exemplary structure of an elastic roller according to an embodiment of the present invention.

FIG. 3 shows an exemplary structure of the elastic roller 65 according to an embodiment of the present invention.

Referring to FIG. 3, the elastic roller 65 has a multi-layered structure such that an elastic layer 65*b* is provided to wrap a core 65*a*, and that a surface layer 65*c* is further provided to enclose the elastic layer 65*b*. It is preferable that the elastic layer 65*b* be configured from an interconnected multiporous material, because an elastic function is provided to the elastic layer 65*b*. For example, the elastic layer 65*b* is preferably formed of polyurethane rubber. Also, since the surface layer 65*c* is required not to extend in response to mechanical stress, it is preferably that the surface layer 65*c* be configured from a less stretchy material than that of the elastic layer 65*b*. For example, the surface layer can be preferably formed of polyimide from the viewpoint of abrasion resistance. Also, these materials may contain a resistance control material such as carbon black, and may contain a lubricant to lower the friction coefficient of the surface layer 65*c* with respect to the hard blade 66.

Figure 4:
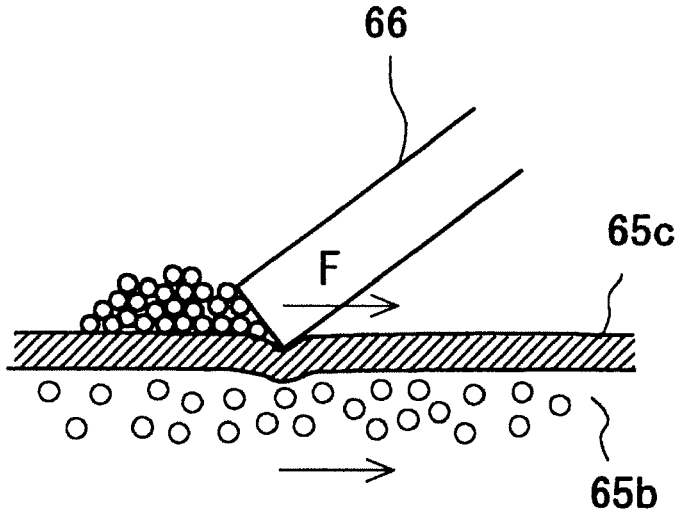
FIG. 4 is an enlarged view showing an exemplary contact portion between the elastic roller and a hard blade according to an embodiment of the present invention.

FIG. 4 is an enlarged view showing an exemplary contact portion between the elastic roller 65 and the hard blade 66.

Referring to FIG. 4, the elastic roller 65 is deformed at the contact portion between the elastic roller 65 and the hard blade 66. This deformation of the elastic roller 65 and the sufficient hardness of the hard blade 66 prevent unfavorable creation of a space through which toner particles pass. In the case where a thinner SUS plate than a conventionally used rubber blade is used as described in this embodiment, the toner particles push the hard blade 66 with less force F. In addition, since the hard blade 66 is more rigid to the force F than a rubber blade, unfavorable passage of the toner particles becomes further more difficult. As a result, the elastic roller 65 can be in contact with the photoconductor 1 in a condition where the surface of the elastic roller 65 is cleaned up. Therefore, it is possible to prevent reduction of the toner collection capability.

The elastic roller 65 can be rotationally driven to shift in the forward direction with respect to the shift direction of the photoconductor 1. Also, it is preferable that the linear speeds of the elastic roller 65 and the photoconductor 1 be the almost same. In such a case, it is possible to lessen damage to the surface of the photoconductor 1 that may be caused by contact between the elastic roller 65 and the photoconductor 1.

As shown in FIG. 2, it is preferable that the antifriction material coating part 62 be embodied as a brush roller. The brush roller 62 is made of a material that mainly includes resin, such as nylon and acrylic resin, volume resistance of which is adjusted to $1\times10^3$ through $1\times10^8$ Ω·cm by additionally containing carbon black as a resistance control material. A solid antifriction material 64 is in contact with the brush roller 62 due to the weight thereof or external depression force. The solid antifriction material 64 may be made of aliphatic metal salt such as lead oleate, zinc oleate, cupper oleate, zinc stearate, cobalt stearate, iron stearate, cupper stearate, zinc palmitate, cupper palmitate and zinc linolenate. In particular, the solid antifriction material 64 is preferably made of zinc stearate.

The rotationally driven brush roller 62 scrapes the solid antifriction material 64, and supplies the fine-grained antifriction material on the surface of the photoconductor 1. Then, when the surface of the photoconductor 1 is in contact with the cleaning blade 61, the antifriction material is spread in a thin film in order to lower the friction coefficient of the surface of the photoconductor 1.

While the brush roller 62 scrapes the solid antifriction material 64 and supplies the fine-grained antifriction material to the photoconductor 1, the brush roller 62 partially catches remaining toner particles on the photoconductor 1 after passage through the elastic roller 65. In particular, after an image is formed at a high image area rate by using small diameter and high roundness toner, it is effective to reduce an amount of toner supplied to the cleaning blade 61 as much as possible for the purpose of better cleaning. At this time, if the brush roller 62 is grounded, the brush roller 62 can catch toner particles by electrostatically attracting the toner particles from the slightly electrified photoconductor 1 as well as mechanically removing the toner particles by the brush roller 62.

Figure 5:
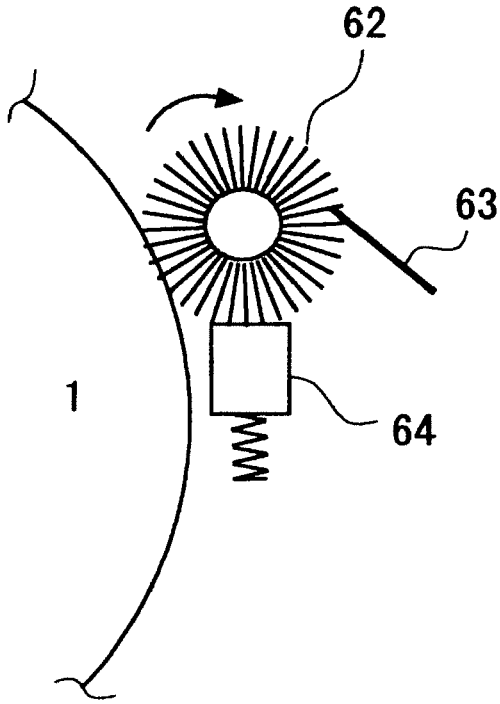
FIG. 5 shows an exemplary structure of a flicker of a brush roller according to an embodiment of the present invention.

FIG. 5 shows an exemplary structure of the brush roller 62 together with a flicker.

Referring to FIG. 5, the elastic roller 65 catches toner particles as described above. Only a small amount of toner is caught in general. However, if the caught toner particles were accumulated without release over time, the brush roller 62 would not be able to satisfactorily coat an antifriction material. In order to eliminate this problem, a flicker 63 is disposed in contact with the brush roller 62, as illustrated in FIG. 5, in order to flip away toner particles between fibers of the brush. As shown in FIG. 5, the flicker 63 is preferably positioned in the downstream side from the contact position between the brush roller 62 and the photoconductor 1 with respect to the rotational direction and in the upstream side from the contact position between the brush roller 62 and the solid antifriction material 64. Before the brush roller 62 scrapes the solid antifriction material 64 and coats the antifriction material on the surface of the photoconductor 1, the flicker 63 removes toner particles attached to brush fibers. As a result, it is possible to coat the antifriction material better. In such a case, the antifriction material is supplied to the photoconductor 1 uniformly, and thereby the surface of the photoconductor 1 has less friction coefficient. In addition, since the sliding friction coefficient of toner is also lowered, it is possible to improve the cleaning performance of the cleaning blade 61.

Furthermore, since the flicker 63 prevents accumulation of toner particles between fibers of the brush roller 62, it is possible to extend life duration of the brush roller 62.

Preferably, the brush roller 62 is rotationally driven in the forward direction with respect to the shift direction of the photoconductor 1. Since the cleaning device 6 includes the elastic roller 65, which serves as toner removing means, in the upstream side from the brush roller 62 with respect to the rotational direction of the photoconductor 1, one of main purposes of the brush roller 62 is to coat the solid antifriction material 64 on the surface of the photoconductor 1. If the toner collection function of the brush roller 62 has priority, it is desirable that the brush roller 62 is rotationally driven in the inverse direction with respect to the shift direction of the photoconductor 1. However, from the above-mentioned reason, the brush roller 62 be rotationally driven in the forward direction with respect to the shift direction of the photoconductor 1, which is preferable for coating the solid antifriction material 64.

A process cartridge integrally supporting the cleaning device 6 and the photoconductor 1 can be configured to be detachably mounted in an image forming apparatus. Such a process cartridge may additionally include the electrifying part 2 and/or the developing part 4. Even in an image formation process where high roundness and small diameter toner is used to form images, the process cartridge can properly clean up the photoconductor 1 and suppress degradation of image quality. Also, since the process cartridge can keep the good cleaning performance thereof in the long term, it is possible to extend the life span of the process cartridge.

When high roundness toner having an average roundness above 0.93 is adopted for use in the developing part 4 of an image forming apparatus, the image forming apparatus will have greater effects on installation of the cleaning device 6 therein. In conventional blade type cleaning, such high roundness toner particles easily enter a space between the photoconductor 1 and the cleaning blade and cannot be satisfactorily caught. On the other hand, if the cleaning blade is in contact with the photoconductor 1 at higher pressure in order to narrow the space, the photoconductor 1 may be heavily damaged. Also, even in the case where the toner particles are attempted to be electrostatically caught by applying bias having inverse polarity of that of the electrified toner particles to the brush roller, it is difficult to completely catch the remaining toner particles from the photoconductor 1 by applying the bias uniformly, because the toner particles are not uniformly electrified.

However, even if the above-mentioned high roundness toner is used, the cleaning device 6 can clean up the surface of the photoconductor 1 with high efficiency as follows. Namely, remaining toner particles on the photoconductor 1 are first electrostatically caught by the elastic roller 65 of the toner removing part. Then, the brush roller 62 as the antifriction coating part coats the solid antifriction material 64 on the surface of the photoconductor 1 in order to lower the friction coefficient of the surface. Finally, the clean blade 61 scrapes away the remaining toner particles. In this manner, the cleaning device 6 can efficiently clean up the surface of the photoconductor 1 without damage.

In addition, the cleaning device 6 is preferably applicable to cleaning of almost round toner particles. In general, round toner can be defined by shape factors SF-1 and SF-2 described in detail below. Toner having the shape factor SF-1 of 100 through 180 and the shape factor SF-2 of 100 through 180 can be used in an image forming apparatus according to an embodiment of the present invention.

Figure 6A:
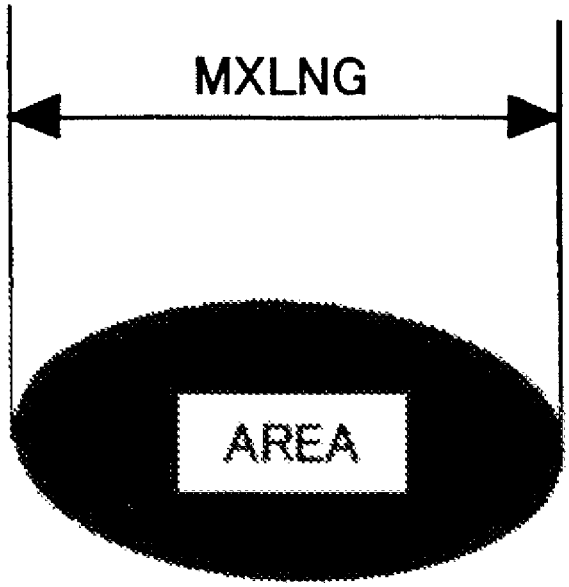
FIGS. 6A and 6B are schematic views showing exemplary toner shapes for the purpose of explain shape coefficients SF-1 and SF-2.
Figure 6B:
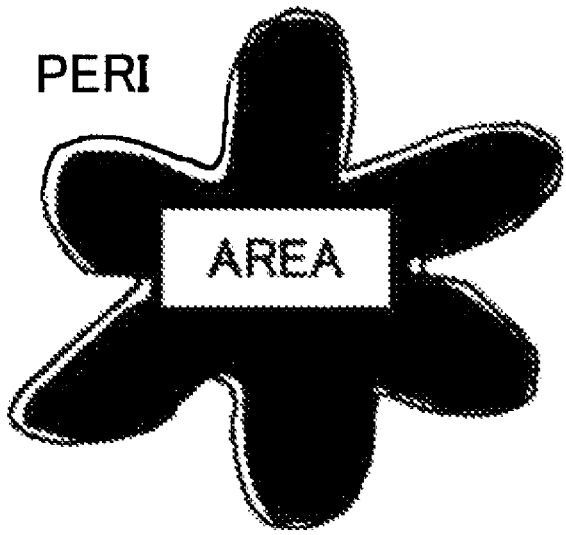

FIGS. 6A and 6B are schematic diagrams showing exemplary shapes of toner particles for explaining the shape factors SF-1 and SF-2.

Referring to FIG. 6A, the shape factor SF-1 represents roundness of a toner particle. The shape factor SF-1 is formulated as follows;

$$SF\text{-}1=\{(MXLNG)^2/AREA\}\times(100\pi/4) \quad (1),$$

where MXLNG represents the maximum length of two-dimensionally projected shape of the toner particle, and AREA represents the area of the projected shape. If the SF-1value of toner is equal to 100, the toner has true roundness. As SF-1 is larger, the toner has indeterminate form.

Referring to FIG. 6B, on the other hand, the shape factor SF-2 represents convexity and concavity of a toner particle. The shape factor SF-2 is formulated as follows;

$$SF\text{-}2=\{(PERI)^2/AREA\}\times(100\pi/4) \quad (2),$$

where PERI represents the peripheral length of two-dimensionally projected shape of the toner particle. If the SF-2 value is equal to 100, the surface of the toner particle has no convexity and concavity at all. As SF-2 is larger, the surface of the toner particle has outstanding convexity or concavity.

In order to measure the shape factors, the toner particle is filmed, for example, with a scanning type electron microscope (S-880 produced by Hitachi, Ltd.), and the obtained picture is analyzed, for example, with an image analysis apparatus (LUSEX3 produced by NIRECO Corporation).

As a toner particle has higher roundness, the toner particle is more likely to point-contact with another toner particle or the photoconductor 1. In this case, adhesion force between these toner particles is weak, thereby making the toner particles highly flowable. Also, while weak adhesion force between the round toner particle and the photoconductor enhances the transfer rate, the round toner is more likely to cause cleaning malfunction for blade type cleaning. However, in this case, the cleaning device 6 can clean up the toner particle well. It is noted that large SF-1 and SF-2 values may deteriorate visual quality of an image due to scattered toner particles on the image. It is preferable that the SF-1 and SF-2 values be less than 180.

Now, the volume average particle diameter and the number average particle diameter, which will be understood by those skilled in the art, are notated as Dv and Dn, respectively. Then, even if toner having a small particle diameter and a concentrated particle diameter distribution, such as, toner having a Dv value of 3 through 8 μm and a ratio (Dv/Dn) of 1.00 through 1.40, is used, the cleaning device 6 performs well. Such concentrated particle distribution causes a uniform electrification distribution, thereby resulting in high-quality fog-free images and achieving an improved transfer rate. According to conventional blade type cleaning, it is difficult to satisfactorily clean up toner particles due to strong adhesion force between the toner particles and the photoconductor 1. Also, since small particle diameter toner tends to contain relatively large external additive particles, desorption of such additive particles from the toner is likely to cause filming on the photoconductor 1. However, when the brush roller 62 of the cleaning device 6 properly coats an antifriction material on the surface of the photoconductor 1, it is possible to lower the friction coefficient of the surface of the photoconductor 1 and improve cleaning performance of the cleaning blade 61.

Toner for preferred use in an image forming apparatus according to the present invention is produced through bridge reaction and/or elongation reaction of a liquid toner material in aqueous solvent. Here, the liquid toner material is generated by dispersing polyester prepolymer comprising aromatic group having at least nitrogen atom, polyester, a coloring agent and a release agent in organic solvent. In the following, toner constituents and a toner manufacturing method are described in detail.

[Modified Polyester]

Toner according to an embodiment of the present invention includes modified polyester (i) as binder resin. As the modified polyester (i), the polyester resin may include a bond group other than ester bond. Also, in the polyester resin, different resin constituents may be covalent and/or ion bonded each other. Specifically, the modified polyester may result from modification of polyester residues by introducing a functional group such as an isocyanate group reacted with a hydroxyl group and a carboxylic acid group to polyester residues and further reacting the resulting compound with an active hydrogen including compound.

The modified polyester (i) may be urea-modified polyester generated by reaction of polyester prepolymer (A) having an isocyanate group and an amine class (B). The polyester prepolymer (A) having an isocyanate group may be generated by reacting polyester, which is a polycondensation compound of polyalcohol (PO) and polycarboxylic acid (PC) and includes polyester having an active hydrogen group, to a polyisocyanate (PIC) compound. Such an active hydrogen group of the polyester may be a hydroxyl group (alcoholic-hydroxyl group and phenolic-hydroxyl group), an amino group, a carboxyl group and a mercapto group. Among these groups, the alcoholic-hydroxyl group is preferred.

The urea-modified polyester is generated as follows. A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1.4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogeneted bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of above-mentioned bisphenols (ethylene oxide, propylene oxide, butylene oxide or the like). Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide addducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, telephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges 1.5/1 through 1/1. In particular, the ratio is preferred between 1.3/1 and 1.02/1.

A polyisocyanate (PIC) compound may be aliphatic polyisocianate (tetramethylene diisocyanate, hexamethylene diisocyanate, 2,6-diisocyanate methylcaproate or the like), alicyclic polyisocyanate (isophoron diisocyanate, cyclohexyl methane diisocyanate or the like), aromatic diisocyanate (trilene diisocyanate, diphenylmethane diisocyanate or the like), aromatic aliphatic diisocyanate ($\alpha, \alpha, \alpha', \alpha'$-tetramethyl xylylene diisocyanate), isocyanates, materials blocked against the polyisocyanate with phenol derivative, oxime, caprolactam or the like, and combinations of two or more of these materials.

The ratio of the polyisocyanate (PIC) compound is normally set between 5/1 and 1/1 as an equivalent ratio [NCO]/[OH] of the isocyanate group [NCO] and the hydroxyl group [OH] of polyester having a hydroxyl group. The ratio is preferably between 4/1 and 1.2/1. In particular, the ratio is preferred between 2.5/1 and 1.5/1. If the ratio [NCO]/[OH] is greater than or equal to 5.0, the ratio degrades low temperature fixability. If the mole ratio of [NCO] is less than or equal to 1.0, ester of urea-modified polyester includes a smaller amount of urea, thereby resulting in degraded hot offset proof.

Polyester prepolymer (A) having an isocyanate group normally includes 0.5 through 40 wt % (part by weight) of polyisocyanate (PIC) compound components. It is preferable that the contained amount be between 1 and 30 wt %. In particular, the amount is preferred between 2 and 20 wt %. If the contained amount is less than 0.5 wt %, the hot offset proof is degraded, and additionally heat-resistant storage capability and low temperature fixability become poor. On the other hand, if the contained amount is larger than or equal to 40 wt %, the low temperature fixability is degraded.

For each molecule of polyester prepolymer (A) having isocyanate groups, one or more isocyanate groups are normally contained. Preferably, the average number of contained isocyanate groups is between 1.5 and 3.0. Further preferably, the average number is between 1.8 and 2.5. If each molecule of polyester prepolymer (A) contains less than one isocyanate group, the molecular weight of urea-modified polyester becomes lower and the hot offset proof is degraded.

Amines (B) which react with polyester prepolymer (A) may be a divalent amine compound (B1), a tri- or more valent polyamine compound (B2), amino alcohol (B3), amino marcaptane (B4), amino acid (B5), B1 to B5 compounds which amino groups are blocked (B6), or the like.

The divalent amine compound (B1) may be aromatic diamine (phenylene diamine, diethyltoluene diamine, 4,4'-diaminodiphenyl methane or the like), alicyclic diamine (4,4'-diamino-3,3'-dimethyldicyclohexylmethane, diamine cyclohexane, isophoron diamine or the like), and aliphatic diamine (ethylene diamine, tetramethylene diamine, hexamethylene diamine or the like). The tri- or more valent polyamine compound (B2) may be diethylene triamine, triethylene tetramine or the like. The amino alcohol (B3) may be ethanol amine, hydoxyethyl aniline or the like. The amino marcaptane (B4) may be aminoethyl mercaptan, aminopropyl mercaptan, or the like. The amino acid (B5) may be amino propioic acid, amino caproic acid or the like. The B1 to B5 compounds which amino groups are blocked (B6) may be ketimine compounds and oxazolidine compounds which can be obtained from the amines and ketones (acetone, methylethyl ketone, methylisobutyl ketone or the like) of B1 through B5. The amines (B) are preferably B1 and a mixture of B1 and a small amount of B2.

The ratio of amines (B) is normally set between 1/2 and 2/1 as an equivalent ratio [NCO]/[NHx] of isocyanate groups [NCO] in polyester prepolymer (A) having isocyanate groups to amino groups [NHx] in amines (B). Preferably, the ratio is between 1.5/1 and 1/1.5. Further preferably, the ratio is between 1.2/1 and 1/1.2. If the ratio is greater than 2 or less than 1/2, the molecular weight of urea-modified polyester is lowered and the hot offset proof is degraded.

Modified polyester (i) for an image forming apparatus according to an embodiment of the present invention can be manufactured in accordance with one-shot method or prepolymer method. The weight-average molecular weight of the modified polyester (i) is normally greater than 10,000. Preferably, the weight-average molecular weight is between 20,000 and 10,000,000. Further preferably, the weight-average molecular weight is between 30,000 and 1,000,000. The peak molecular weight is preferably between 1,000 and 10,000. If the peak molecular weight is less than 1,000, elongation reaction less likely occurs and toner has smaller elasticity. As a result, the hot offset proof is degraded. On the other hand, if the peak molecular weight is greater than 10,000, the fixability is lowered, and it becomes more difficult to properly manufacture the toner in the matter of particle formation and pulverization. The number-average molecular weight of the modified polyester (i), if unmodified polyester (ii) is used, is not limited. The modified polyester (i) may have any number-average molecular weight such that the weight-average molecular weight can be within the above-mentioned range. If only the modified polyester (i) is used, the number-average molecular weight is normally set as less than 20,000. Preferably, the number-average molecular weight is set between 1,000 and 10,000. Further preferably, the number-average molecular weight is between 2,000 and 8,000. If the number-average molecular weight is larger than 20,000, the low temperature fixability and the brightness for a full-color device are degraded.

In bridge reaction and/or elongation reaction of polyester prepolymer (A) and amines (B), which is for generating modified polyester (i), a reaction terminating agent may be used as needed to adjust the molecular weight of obtained urea-modified polyester. Such a reaction terminating agent may be monoamine (diethylamine, dibutylamine, butylamine, lauryl amine or the like), and compounds thereof which amines are blocked compounds (ketimine compounds).

[Unmodified Polyester]

In the present invention, although only the modified polyester (i) can be used as described above, unmodified polyester (ii) together with the modified polyester (i) can be contained as a binder resin constituent. When the unmodified polyester (ii) is used together, it is possible to achieve better low temperature fixability and brightness for a full-color device than those obtained for use of only the modified polyester. The unmodified polyester (ii) may be polycondensation compounds of polyalcohol (PO) and polycarboxylic acid (PC) as in the above-mentioned polyester components of the modified polyester (i). The same materials as those of the modified polyester (i) are preferred. Also, the unmodified polyester (ii) may be compounds modified in chemical bonding other than urea bonding as well as unmodified polyester. For example, the polyester is modified in urethane bonding. It is preferable that at least a portion of both the modified and unmodified polyester (i) and (ii) is dissolved in terms of low temperature fixability and hot offset proof. Accordingly, the modified and unmodified polyester (i) and (ii) preferably have similar polyester compositions. If the unmodified polyester (ii) is included, the weight ratio of the modified polyester (i) to the unmodified polyester (ii) is normally set between 5/95 through 80/20. Preferably, the weight ratio is between 5/95 and 30/70. Moreover preferably, the weight ratio is between 5/95 and 25/75. In particular, the weight ratio is preferably between 7/93 and 20/80. If the weight ratio is less than 5%, the hot offset proof is degraded, and additionally the heat-resistant storage capability and the low temperature fixability become poor.

The peak molecular weight of the unmodified polyester (ii) is normally set between 1,000 and 10,000. Preferably, the peak molecular weight is between 2,000 and 8,000. Moreover preferably, the peak molecular weight is between 2,000 and 5,000. If the peak molecular weight is less than 1,000, the heat-resistant strage capability is degraded. On the other hand, if the peak molecular weight is greater than 10,000, the low temperature fixability is degraded. Also, the unmodified polyester (ii) has penta- or more valent hydroxyl groups. Moreover preferably, 10 through 120 valent hydroxyl groups are preferred. In particular, 20 through 80 valent hydroxyl groups are preferred. If the unmodified polyester (ii) has tetra- or less valent hydroxyl groups, the unmodified polyester (ii) is not preferred in terms of both the heat-resistant storage capability and the low temperature fixability. It is preferable that the acid value of the unmodified polyester be between one and five. Moreover preferably, the acid number is within two through four. Since high acid value wax is used, and low acid value binder is linked to electrification and high volume resistance, such unmodified polyester (ii) is suitable for toner used as a binary developer.

A glass transition point (Tg) of binder resin is normally set to be within 35 through 7020 C. Preferably, Tg is within 55 through 65° C. If TG is less than 35° C., the heat-resistant storage capability is degraded. On the other hand, if Tg is greater than 70° C., the low temperature fixability becomes insufficient. Urea-modified polyester is likely to be on the surfaces of obtained toner parent body particles. Accordingly, toner according to an embodiment of the present invention, even if the glass transition point is low, tends to show better heat-resistant storage capability than known polyester toner does.

[Colorant]

All known dyes and pigments are available as a colorant of toner according to an embodiment of the present invention. For example, such a colorant mat be carbon black, nigrosine dye, iron black, naphtol yellow-S, Hansa yellow (10G, 5G, G), cadmium yellow, yellow oxide, ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, colcothar, minium, lead vermilion, cadmium red, cadmium mercury red, antimony vermilion, permanent red 4R, para red, para-chloro-ortho-nitroaniline red, lithol fast scarlet G, brilliant fast scarlet, brilliant carmine BS, permanent red (F2R, F4R, FRL, FRLL, F4RH), fast scarlet VD, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON marron light, BON marron medium, eosine lake, rhodamine lake B. rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, Victoria blue lake, no metal-containing phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, Litobon and mixtures thereof. The containing amount of a colorant in toner is normally set between 1 and 15 weight percent. Preferably, the containing amount is between 3 and 10 weight percent.

A colorant may be used as masterbatch combined with resin. Such masterbatch may be manufactured from or mixed as binder resin together with: polystyrene, poly-p-chlorostyrene, styrenes such as polyvinyltoluene and substituted polymer thereof, copolymer of the above-mentioned compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butylal, polyacrylate resin, rosin, modified rosin, terpene resin, aliphatic or alicyclic hydrocarbon resin, aromatic petroleum resin, chlorinated paraffin, paraffin wax or the like. These materials can be used as a single material or a compound thereof.

[Charge Control Agent]

In the present invention, existing charge control agents are available. For example, the charge control agent may be nigrosin dye, triphenylmethane dye, chrome-containing metal complex dye, moribdate-chelated pigment, rhodamine dye, alkoxy amine, quaternary ammonium salt (including fluride-modified quaternary ammonium salt), alkylamide, phosphorous or phosphorous-containing compounds, tungsten or tungsten-containing compounds, fluorinated active agent, metal salicylate, salicylate derivative metal salts or the like. Specifically, the charge control agent may be nigrosin dye BONTRON 03, quaternary ammonium salt BONTRON P-51, metal-containing azo dye BONTRON S-34, oxynaphthate metal complex E-82, salicylate metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hoechst), LRA-901, boron complex LR-147 (which are produced by Japan Carlit Co., Ltd.), copper phthalocyanine, perylene, quinacridone, azo pigment, and high-molecular-weight-compounds having sulfonyl, carboxyl, or quanternary ammonium salt group. In particular, materials that can control toner to have negative polarity are preferably used.

The use amount of the charge control agent is determined depending on types of binder resin, presence of additives used as needed, and toner manufacturing methods including a dispersion method, and therefore cannot be not uniquely determined. However, the charge control agent is normally used within a weight part of 0.1 through 10 for the weight part 100 of binder resin. Preferably, the charge control agent is within a weight part of 0.2 through 5. If the weight is above 10, toner particles are electrified too much. As a result, the charge control agent becomes less effective, resulting in increasing electrostatic suction power with a developing roller, decreasing fixability of developer, and lowered image density.

[Release Agent]

Low melting point waxes, for example, which have a melting point of 50 through 120° C., are available as a release agent. Such low melting point waxes effectively work as a release agent between a fixing roller and a toner boundary in dispersion with binder resin. Thereby, it is possible to realize effective high temperature offset without coating of a release agent, such as oil, on the fixing roller. Such waxes may have the following constituents. Brazing filler metal and waxes may include waxes derived from plants, such as carnauba, cotton brazing filter metal, wood brazing filter metal, rice brazing filter metal, waxes derived from animals, such as yellow beeswax and lanolin, waxes derived from mineral substances, such as ozokerite and cercine, and petroleum waxes, such as paraffin wax, microcrystalline and petrolatum. Apart from these natural waxes, synthesized hydrocarbon waxes, such as Fischer-Tropsch wax and polyethylene wax, and synthesized wax, such as ester, ketone and ether, may be used. In addition, aliphatic amide such as 12-hydroxystearate amide, amide stearate, imide phthalate anhydride and chlorinated hydrocarbon, crystalline polymer resin having low molecular weight homopolymer or copolymer such as poly-n-laurylmethacrylate and poly-n-stearylmethacrylate (for example, n-stearylacrylate-ethylmethacrylate copolymer), and crystalline polymer which side chain has long alkyl group may be used.

A charge control agent and a release agent together with masterbatch and binder resin may be fused and mixed, and may be dissolved and dispersed in organic solvent.

[External Additives]

Inorganic fine particles are preferable used as an external additive to facilitate flowability, developability and electrifiability of toner particles. Such an inorganic fine particle preferably has a primary particle diameter of $5\times10^{-3}$ through 2 μm. In particular, it is preferable that the primary particle diameter be between $5\times10^{-3}$ and 0.5 μm. BET specific surface area is preferably between 20 and 500 $m^2/g$. The use ratio of the inorganic fine particles is preferably between 0.01 and 5 wt % to toner particles. In particular, the use ratio is preferably between 0.01 and 2.0 wt %.

Specifically, such inorganic particles may be formed of silica, alumina, titanium oxide, barium titanate, magnesium titanate, calcium titanate, strontium titanate, zinc oxide, tin oxide, silica sand, clay, mica, wollatonite, diatomite, chromium oxide, cerium oxide, colcothar, antimony trioxide, magnesium oxide, zirconium oxide, barium sulfate, barium carbonate, calcium carbonate, silicon carbide, silicon nitride or the like. Among these materials, hydrophobic silica particles and hydrophobic titanium oxide particles are used together as an agent to provide flowability. In particular, when these particles having an average diameter of less than $5\times10^{-2}$ μm are mixed, electrostatic force and Van der Waals force with toner particles are considerably improved. As a result, even if such external additives are mixed with toner particles in a developing device in order to achieve a desired electrification level, it is possible to obtain a firefly-free good image without desorption of a flowability accelerator agent from toner particles, and further reduce an amount of remaining toner after transferring.

While titanium oxide fine particles have high environmental stability and image density stability, the titanium oxide fine particles have an insufficient electrification start feature. As a result, if more titanium oxide fine particles are contained than silica fine particles, this adverse effect becomes more influential. However, if hydrophobic silica particles and hydrophobic titanium oxide particles are contained within 0.3 through 1.5 wt %, a desired electrification start feature is obtained without significant damage. In other words, even if an image is repeatedly copied, it is possible to achieve stable image quality for each copy.

Preferred embodiments of a toner manufacturing method according to the present invention are described herein. However, the present invention is not limited to these embodiments.

[Toner Manufacturing Method]

1) In order to produce toner material liquid, colorant, unmodified polyester, polyester prepolymer having isocyanate group, and a release agent are dispersed in organic solvent.

From the viewpoint of removal after formation of toner source particles, it is preferable that the organic solvent be volatile and have a boiling point of less than 100° C. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, methylisobutylketone and compounds thereof are available. In particular, aromatic solvent such as toluene and xylene, and chlorinated hydrocarbon such as methylene chloride, 1,2-dichloroethane, chloroform and carbon tetrachloride, are preferred. For 100 w/t parts of polyester prepolymer, 0 through 300 w/t parts of organic solvent are normally used. Preferably, 0 through 100 w/t parts are used. Further preferably, 25 through 70 w/t parts are used.

2) The toner material liquid together with a surface-active agent and resin fine particles is emulsified in aqueous solvent.

Such aqueous solvent may be water or organic solvent such as alcohol (methanol, isopropylalcohol, ethylene glycol or the like), dimethyl formamide, tetrahydrofuran, cellosolves (methylcellosolve), lower ketones (acetone, methylethylketone or the like).

For 100 w/t parts of the toner material liquid, 50 through 2,000 w/t parts of aqueous solvent is normally used. The 100 through 1,000 w/t parts are preferred. If the part by weight of the aqueous solvent is less than 50, the toner material liquid is poorly dispersed, and thereby it is impossible to obtain toner particles having a predefined diameter. On the other hand, if the part by weight of the aqueous solvent is larger than 20,000, that is economically inefficient.

Also, for the purpose of good dispersion in aqueous solvent, a dispersion agent such as a surface-active agent and resin fine particles is added as needed.

Such a surface-active agent may be alkylbenzene sulfonate salt, α-olefin sulfonate salt, anionic surfactant such as phosphate ester, alkyl amine salt, aminoalcohol fatty acid derivatives, polyamin fatty acid derivatives, amine salt such as imidazoline, alkyltrimethyl ammonium salt, dialkyldimethyl ammonium salt, alkyldimethylbenzyl ammonium salt, pyridinium salt, alkylisoquinolinium salt, cationic surfactant quaternary ammonium salt such as benzethonium chloride, fatty amide derivatives, non-ionic surfactant such as multivalent alcohol derivatives, and amphoteric surfactant such as alanine, dodecyl (aminoethyl) glycine, di(octylaminoethyl)glycine, N-alkyl-N,N-dimethylammonium betaine.

Also, even if a small amount of a surface-active agent having fluoroalkyl group is used, the surface-active agent works well. Preferred anionic surfactant having fluoroalkyl group may be fluoroalkylcarboxylic acid having 2-10 carbon atoms and metal salt thereof, disodium perfluorooctanesulfonyl glutamate, sodium 3-[107 -fluoroalkyl (C6-C11)oxy]-1-alkyl (C3-C4) sulfonate, sodium 3-[ω-fluoroalkanoyl (C6-C8)oxy]-N-ethylamino]-1-propane sulfonate, fluoroalkyl (C11-C20) carboxylic acid and metal salts thereof, perfluoroalkylcarboxilic acid (C7-C13) and metal salts thereof, perfluoroalkyl (C4-C12) sulfonic acid and metal salt thereof, perfluorooctanesulfonic acid diethanolamide, N-propyl-N-(2-hydroxyethyl)-perfluorooctanesulfonamide, propyltrimethylammonium salt of a perfluoroalkyl (C6-C10) sulfonamide, salt of perfluoroalkyl (C6-C10)-N-ethylsulfonylglycine, monoperfluoroalkyl (C6-C16) ethyl phosphate ester or the like.

Commercially, Surflon S-111, S-112 and S113 (which are produced by Asahi Glass Co., Ltd.), Florad FC-93, FC-95, FC-98 and FC-129 (which are produced by Sumitomo 3M Ltd.), Unidyne DS-101 and DS-102 (which are produced by Daikin Industry Ltd.), Megaface F-110, F-120, F-113, F-191, F-812 and F-833 (which are produced by Dainippon Ink and Chemicals, Inc.), Ektop EF-102, EF-103, EF-104, EF-105, EF-112, EF-123A, EF-123B, EF-306A, EF-501, EF-201 and EF-204 (which are produced by Tohkem products), and Ftergent F-100 and F-150 (which are produced by Neos) are available.

Also, cationic surfactant may be aliphatic primary or secondary amino acid having fluoroalkyl group, alphatic quaternary ammonium salt such as ammonium salt of perfluoroalkyl (C6-C10) sulfonamide propyltrimethyl, benzalkonium salt, benzethonium chloride, pyridinium salt, imidazolinium salt, commercially, Surflon S-121, Florad FC-135, Unidyne DS-202, Megaface F-150 and F-824, Ektop EF-132, Ftergent F-300 or the like.

Resin fine particles are added to stabilize toner source particles formed in aqueous solvent. The resin fine particles are preferably added such that the coverage ratio thereof on the surface of a toner source particle can be within 10 through 90%. For example, such resin fine particles may be methyl polymethacrylate particles of 1 μm and 3 μm, polystyrene particles of 0.5 μm and 2 μm, poly(styrene-acrylonitrile) particles of 1 μm, commercially, PB-200 (which is produced by Kao Co.), SGP, SGP-3G (Soken), technopolymer SB (Sekisui Plastics Co., Ltd.), micropearl (Sekisui Chemical Co., Ltd.) or the like.

Also, inorganic dispersant such as calcium triphosphate, calcium carbonate, titanium oxide, coloidal silica and hydroxyapatite may be used.

In order to make dispersed drops stable, polymer protective colloid may be used together with the above-mentioned resin fine particles and inorganic dispersant. For example, acid compounds such as acrylic acid, methacrylic acid, α-cyanoacrylic acid, α-cyanomethacrylic acid, itaconic acid, crotonic acid, fumaric acid, maleic acid and maleic anhydride, or (meth)acrylic monomer with a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, ester from diethylene glycol and monoacrylic acid, ester from diethylene glycol and monomethacrylic acid, ester from glycerin and monoarylic acid, ester from glycerin and monometharylic acid, N-methyolacrylamide and N-methylolmethacrylamide, vinyl alcohol or ethers from vinyl alcohol such as vinylmethyether, binylethylether and binylpropylether, esters from vinylalcohol and compound having carboxylic group such as vinyl acetate, vinyl propionate and vinyl lactate, acrylamide, methacrylamide, diacetoneacrylamide or methylol compounds thereof, acid chlorides such as acryloyl chloride and methacrylate chloride, nitrogen-containing compounds such as vinylpyridine, vinylpyrrolidone, vinylimidazol and ethyleneimine, homopolymer or co-polymer having heterocycles thereof, polyoxyethylene-based ones such as polyoxyethylene, polyoxypropylene, polyoxyethylene alikylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearyl phenyl ester and polyoxyethylene nonyl phenyl ester, and celluloses such as methyl cellulose, hydroxyethyl cellulose and hydroxypropyl cellulose, are available.

The present invention is not limited to any certain dispersion method. Well-known techniques, such as low-speed shred type, high-speed shred type, friction type, high-pressure jet type and ultrasonic type, are available. In particular, the high-speed shred type dispersion apparatus is preferred to obtain dispersed particles having a diameter of 2 through 20 μm. If such a high-speed shred type dispersion apparatus is used, the rotation speed is not limited. However, the rotation speed is normally set within 1,000 through 30,000 rpm. Preferably, the rotation speed is within 5,000 through 20,000 rpm. Also, although the dispersion time is not limited to a certain time period, the dispersion time is normally set within 0.1 through 5 minutes for a batch method. The temperature during dispersion is normally kept between 0 and 150° C. (under pressure). Preferably, the temperature is kept between 40 and 98° C.

3) During production of emulsion liquid, amines (B) are added to react with polyester prepolymer (A) having isocyanate group.

This reaction involves bridge and/or elongation of molecule chain. The reaction time is determined depending on reactivity of the structure of the isocyanate group of the polyester prepolymer (A) and the amines (B). The reaction time is normally set between 10 minutes and 40 hours. Preferably, the reaction time is set between 2 and 24 hours. In addition, existing catalysts may be used as needed. Specifically, dibutyl tin laurate, dioctyl tin laurate or the like are available.

4) After completion of the reaction, organic solvent is removed from the emulsified dispersed reactant, and subsequently the resulting material is cleaned and dried to obtain toner source particles.

In order to remove the organic solvent, for example, the emulsified dispersed reactant is gradually heated while laminar flow is stirred. After brisk stirring in a certain temperature range, it is possible to produce spindle-shaped toner source particles by removing the organic solvent. Also, if acids such as calcium phosphates or alkali soluble materials are used as a dispersion stabilizing agent, such calcium phosphates are dissolved by using acids such as hydrochloric acid, and then the resulting material is cleaned by using water so as to remove the calcium phosphates from the toner source particles. The removal may be conducted through enzyme decomposition.

5) A charge control agent is provided to the obtained toner source particles. Then, inorganic particles such as silica particles and titaneum oxide particles are added to obtain toner.

In accordance with a well-known method, for example, a method using a mixer, the charge control agent is provided, and the inorganic particles are added.

According to the above-mentioned toner manufacturing method, it is possible to easily obtain toner particles having a small diameter and a sharp diameter distribution. Furthermore, if emulsified dispersed reactant is intensively stirred during removal process of organic solvent, it is possible to control the shape of toner source particles between true spherical shape and spindle shape. Moreover, it is possible to control surface morphology between smooth surface and rough surface.

Toner according to an embodiment of the present invention has almost spherical shape as in the following shape definition.

Figure 7A:
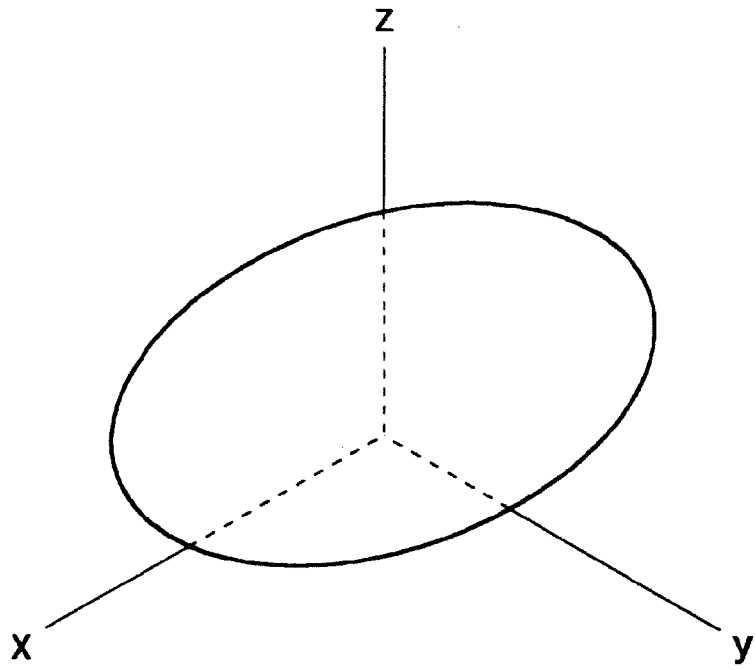
FIGS. 7A through 7C show exemplary shape of a toner particle according to an embodiment of the present invention.
Figure 7B:
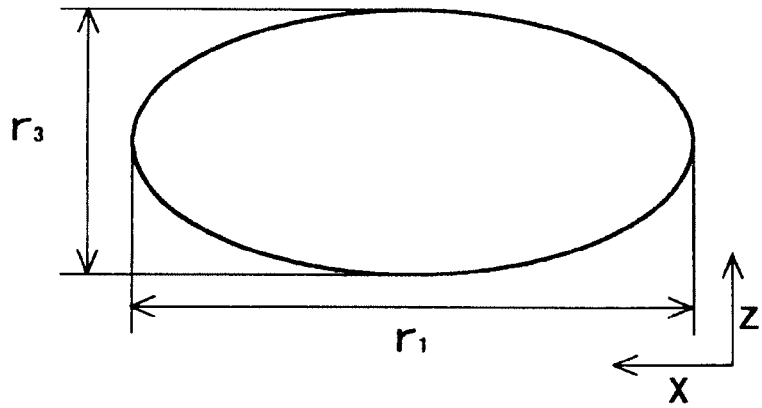
Figure 7C:
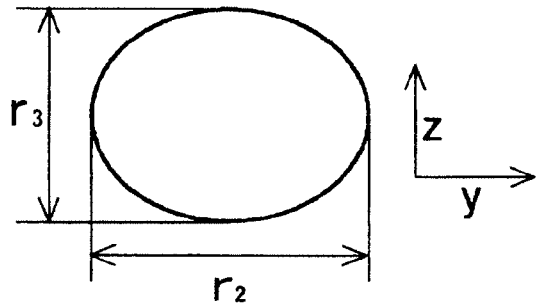

FIGS. 7A through 7C are schematic views showing exemplary shape of a toner particle according to an embodiment of the present invention.

Referring to FIGS. 7A through 7C, such an almost spherical toner particle is defined by the major axial length r1, the minor axial length r2 and the thickness r3 (r1≧r2≧r3). A toner particle according to the present invention preferably has shape such that the ratio of the minor axial length r2 to the major axial length r1 (r2/r1) is between 0.5 and 1.0, and the ratio of the thickness r3 to the minor axial length r2 (r3/r2) is between 0.7 and 1.0. If the ratio (r2/r1) is less than 0.5, the toner particle is substantially different from true spherical shape. As a result, it is impossible to obtain high-quality images because of insufficient dot reproducibility and transfer efficiency. Also, if the ratio (r2/r1) is less than 0.7, the toner particle has nearly flat shape. As a result, it is impossible to achieve a high transfer rate unlike a spherical toner particle. In particular, if the ratio (r3/r2) is equal to 1.0, the toner particle has a body of rotation. As a result, it is possible to improve toner flowability.

It is noted that the lengths r1, r2 and r3 are measured by taking pictures of the toner particle from different viewing angles by using a scanning electron microscope (SEM).

Toner manufactured in this manner can be used as single-component magnetic toner without magnetic carrier or non-magnetic toner.

Also, if the manufactured toner is used in two-component developer, the toner may be mixed with magnetic carrier. Such magnetic carrier may be ferrite containing divalent metal such as iron, magnetite, manganese, zinc and cupper, and preferably has a volume average particle diameter of 20 through 100 μm. If the average particle diameter is less than 20 μm, it is likely that carrier may be attached on the photoconductor 1 during development. On the other hand, if the average diameter is larger than 100 μm, toner particles are insufficiently electrified because of unsatisfactory mixture. In this case, when the developing device is continuously operated, there is a risk that electrification may malfunction. Also, zinc containing Cu ferrite is preferred because of high saturation magnetization. However, ferrite may be selected depending on process of the image forming apparatus 100. Magnetic carrier covering resin is not limited to certain resin. For example, the magnetic ccarrier convering resin may be silicone resin, styrene-acryl resin, flurine-contained resin, olefin resin or the like. The magnetic carrier covering resin may be manufactured by dissolving coating resin in solvent and spaying the resulting solution in a fluidized bed to coat the resin on a core. Alternatively, after resin particles are electrostatically attached to core particles, the resulting particles may be melt for the coverage. The thickness of the covered resin is normally between 0.05 and 10 μm, and preferably between 0.3 and 4 μm.

The present invention is not limited to the specifically disclosed embodiments, and variations and modifications may be made without departing from the scope of the present invention.

The present application is based on Japanese Patent Priority Application No. 2003-132989 filed May 12, 2003, the entire contents of which are hereby incorporated by reference.

What is claimed is:

1. A cleaning device for cleaning a photoconductor member, comprising:

a cleaning blade configured to remove toner attached onto a surface of the photoconductive member;

a lubricant applying device including a brush roller and a solid lubricant, the brush roller being positioned below the solid lubricant in a vertical direction perpendicular to ground, the lubricant applying device being configured to apply some of the solid lubricant onto the surface of the photoconductive member; and a toner transporting device configured to transport the toner removed from the photoconductive member, wherein a portion of the toner transporting device is positioned directly below a portion of the lubricant applying device including at least the solid lubricant in the vertical direction perpendicular to the ground.

2. The cleaning device as claimed in claim 1, wherein the lubricant applying device is disposed upstream from the cleaning blade with respect to a rotational direction of the photoconductive member.

3. The cleaning device as claimed in claim 1, wherein a portion of the solid lubricant is positioned above a portion of the toner transporting device in the vertical direction perpendicular to the ground.

4. The cleaning device as claimed in claim 3, wherein the toner transporting device comprises a toner transfer screw, wherein a portion of the solid lubricant is positioned above the toner transfer screw in the vertical direction perpendicular to the ground.

5. The cleaning device as claimed in claim 3, wherein the brush roller is made of a material whose volume resistance is $1\times10^3$ through $1\times10^8$ Ω·m.

6. A process cartridge for an image forming apparatus wherein the process cartridge is detachably mounted in the image forming apparatus, comprising:

a photoconductor member;

a cleaning device configured to clean a surface of the photoconductor member, the cleaning device comprising:

a cleaning blade configured to remove toner attached onto a surface of the photoconductive member;

a lubricant applying device including a brush roller and a solid lubricant, the brush roller being positioned below the solid lubricant in a vertical direction perpendicular to ground, the lubricant applying device being configured to apply some of the solid lubricant onto the surface of the photoconductive member; and a toner transporting device configured to transport the toner removed from the photoconductive member, wherein a portion of the toner transporting device is positioned directly below a portion of the lubricant applying device including at least the solid lubricant in the vertical direction perpendicular to the ground.

7. The process cartridge as claimed in claim 6, wherein the lubricant applying device is disposed upstream from the cleaning blade with respect to a rotational direction of the photoconductive member.

8. The process cartridge as claimed in claim 6, wherein a portion of the solid lubricant is positioned above a portion of the toner transporting device in the vertical direction perpendicular to the ground.

9. The process cartridge as claimed in claim 8, wherein the toner transporting device comprises a toner transfer screw, wherein a portion of the solid lubricant is positioned above the toner transfer screw in the vertical direction perpendicular to the ground.

10. The process cartridge as claimed in claim 8, wherein the brush roller is made of a material whose volume resistance is $1\times10^3$ through $1\times10^8$ Ω·m..

11. An image forming apparatus, comprising:

a photoconductor member;

an electrifying part configured to electrify a surface of the photoconductor member uniformly;

an exposing part configured to expose the electrified surface of the photoconductor member based on image data in order to write a latent image;

a developing part configured to make the latent image visible by supplying toner particles to the latent image formed on the surface of the photoconductor member;

a transferring part configured to transfer the visible image on the surface of the photoconductor member onto a transferring medium;

a cleaning device configured to clean a surface of the photoconductor member, the cleaning device comprising:

a cleaning blade configured to remove toner attached onto a surface of the photoconductive member;

a lubricant applying device including a brush roller and a solid lubricant, the brush roller being positioned below the solid lubricant in a vertical direction perpendicular to ground, the lubricant applying device being configured to apply some of the solid lubricant onto the surface of the photoconductive member; and a toner transporting device configured to transport the toner removed from the photoconductive member, wherein a portion of the toner transporting device including at least the solid lubricant is positioned directly below a portion of the lubricant applying device in the vertical direction perpendicular to the ground.

12. The image forming apparatus as claimed in claim 11, wherein the lubricant applying device is disposed upstream from the cleaning blade with respect to a rotational direction of the photoconductive member.

13. The image forming apparatus as claimed in claim 11, wherein a portion of the solid lubricant is positioned above a portion of the toner transporting device in the vertical direction perpendicular to the ground.

14. The image forming apparatus as claimed in claim 13, wherein the toner transporting device comprises a toner transfer screw, wherein a portion of the solid lubricant is positioned above the toner transfer screw in the vertical direction perpendicular to the ground.

15. The image forming apparatus as claimed in claim 13, wherein the brush roller is made of a material whose volume resistance is $1\times10^3$ through $1\times10^8$ Ω·m.

* * * * *

UNITED STATES PATENT AND TRADEMARK OFFICE

CERTIFICATE OF CORRECTION

PATENT NO. : 7,493,075 B2
APPLICATION NO. : 11/685660
DATED : February 17, 2009
INVENTOR(S) : Shintani et al.

It is certified that error appears in the above-identified patent and that said Letters Patent is hereby corrected as shown below:

On the title page, Item (75), the Inventor information is incorrect. Item (75) should read:

-- (75) Takeshi Shintani, Kanagawa (JP); Takuji Yoneda, Tokyo (JP); Toshio Koike, Kanagawa (JP); Masato Yanagida, Tokyo (JP); Naohiro Kumagai, Kanagawa (JP); Hiroyuki Nagashima, Kanagawa (JP); Atsushi Sampe, Kanagawa (JP); Eisaku Murakami, Tokyo (JP); Masanori Kawasumi, Kanagawa (JP); Takeshi Uchitani, Kanagawa (JP); Masami Tomita, Shizuoka (JP) --

Signed and Sealed this

Fourteenth Day of April, 2009

JOHN DOLL
*Acting Director of the United States Patent and Trademark Office*